US006176939B1

(12) United States Patent
Oechsle et al.

(10) Patent No.: US 6,176,939 B1
(45) **Date of Patent: *Jan. 23, 2001**

(54) CLEANING DEVICE AND PROCESS

(75) Inventors: Markus Oechsle, Bartholomae; Karlheinz Straub, Heidenheim, both of (DE)

(73) Assignee: Voith Sulzer Papiermaschinen GmbH, Heidenheim (DE)

( * ) Notice: Under 35 U.S.C. 154(b), the term of this patent shall be extended for 0 days.

This patent is subject to a terminal disclaimer.

(21) Appl. No.: 09/527,806

(22) Filed: Mar. 17, 2000

Related U.S. Application Data

(63) Continuation of application No. 09/047,392, filed on Mar. 25, 1998, now Pat. No. 6,053,986.

(30) Foreign Application Priority Data

Mar. 26, 1997 (DE) ..... 197 12 753

(51) Int. Cl.[7] ..... B08B 3/02

(52) U.S. Cl. ..... 134/15; 134/122 R; 134/144; 134/172

(58) Field of Search ..... 134/144, 172, 134/122 R, 15; 162/272, 275, 278

(56) References Cited

U.S. PATENT DOCUMENTS 3,830,691 * 8/1974 Truesdale et al. ..... 162/273
3,995,684 * 12/1976 Schmid ..... 134/122 R X
4,912,946 * 4/1990 Keller ..... 68/5 D
4,989,785 * 2/1991 Walendowski ..... 239/227
5,069,234 * 12/1991 Nielsen ..... 134/113
5,220,935 * 6/1993 Bailey et al. ..... 134/102.1
5,361,791 * 11/1994 Chapman et al. ..... 134/122 R
5,476,567 * 12/1995 Fujisawa et al. ..... 156/281
5,783,044 * 7/1998 Schnider et al. ..... 162/278
5,879,515 * 3/1999 Straub et al. ..... 162/275
6,053,986 * 4/2000 Oechsle et al. ..... 134/15

FOREIGN PATENT DOCUMENTS

9208909 * 2/1992 (DE) .
295 21 159 U * 9/1992 (DE) .
295 03 752 U * 4/1995 (DE) .
19539015 * 10/1996 (DE) .

* cited by examiner

*Primary Examiner*—Philip R. Coe
(74) *Attorney, Agent, or Firm*—Greenblum & Bernstein, P.L.C.

(57) ABSTRACT

A device to clean a transport belt of a machine for manufacturing a material web, in particular paper or cardboard web, is provided which includes at least one nozzle that can impart a medium under pressure and is designed to rotate on a rotational axis. The device is characterized in that the rotational speed of the nozzle for a gentle cleaning of the transport belt lies in the range of from about 2500 rpm to about 4000 rpm, and for an intensive cleaning of the transport belt in the range of from about 1000 rpm to about 2500 rpm.

19 Claims, 2 Drawing Sheets

CLEANING DEVICE AND PROCESS

CROSS-REFERENCE TO RELATED APPLICATIONS

This application is a continuation of U.S. patent application Ser. No. 09/047,392, filed Mar. 25, 1998, and now U.S. Pat. No. 6,053,986, the contents of which are expressly incorporated by reference herein in its entirety.

The present invention also claims the priority under 35 U.S.C. §119 of German Patent Application No. 197 12 753.3 filed on Mar. 26, 1997, the disclosure of which is expressly incorporated by reference herein in its entirety.

BACKGROUND OF THE INVENTION

1. Field of the Invention

The invention relates to a device for cleaning a transport belt of a machine for manufacturing a material web, in particular a paper or cardboard web and to a device for cleaning a transport belt of a machine for manufacturing a pulp web, in particular a paper or cardboard web. The cleaning device includes at least one nozzle for imparting a medium under pressure onto the respective transport belt. The nozzle is designed to rotate about a rotational axis at different rotational speeds and where the rotational axis of the nozzle may be tilted.

2. Discussion of Background Information

Devices of the type mentioned here are known. They serve to clean a transport belt, for example, a drying sieve or a press felt, of a machine to manufacture a pulp web. The cleaning device comprises a nozzle that can impart a medium under pressure, for example a liquid, and it is designed to be rotatable about a rotational axis. The spray emanating from the nozzle, which essentially impacts the transport belt vertically removes dirt, pulp fibers, particles, adhesives and the like from the transport belt. Through the rotational movement of the nozzle, the medium is applied to a surface area of the transport belt, through which a uniform cleaning can be achieved. It has been observed that the cleaning effect of the known cleaning devices do not always satisfy the demands and can therefore be improved upon. Furthermore, cleaning devices are known that avoid an insufficient cleaning in that the rotating nozzle imparts a medium under high pressure upon the transport belt. Thus, the power of the spray impacting the transport belt is increased, thereby increasing the cleaning effectiveness. However, it is disadvantageous in that the transport belt is subjected to the intense force of a hard spray, which, for the most part, impacts it vertically; sensitive transport belts, for example those that are made of a fine fabric, are subject to wear and tear, even to outright damage.

SUMMARY OF THE INVENTION

The present invention creates a cleaning device of the type named at the outset that does not demonstrate these disadvantages.

Accordingly, a cleaning device is provided that includes a nozzle that rotates about a rotational axis and wherein the rotational speed of the nozzle, in order to gently clean the transport belt, lies in the range of about 2500 rpm to about 4000 rpm and, for a more intensive cleaning of the transport belt, lies in the range of about 1000 rpm to about 2500 rpm. Through the high rotational speed of the nozzle, the period of time that the spray impacts the same portion of the transport belt is shortened as opposed to that of a slower rotation speed. This makes it possible to use the nozzle to impart a medium under high pressure upon the transport belt to increase the cleaning effectiveness and at the same time to keep the demands on the transport belt low, such that wear of or damage to the transport belt can be practically eliminated.

The force or the energy of the spray emanating from the nozzle at a high speed can also be used to gently clean the transport belt, since the high rotational speed allows the effects that are abrasive to a transport belt to be reduced to a harmless level. Dry sieves and press felts are examples of pinned or multi-filament sieves that undergo a gentle cleaning. The term "multifilament" characterizes transport belts that demonstrate a construction similar to that of textile fabric. The textile fabric consists of interwoven thread fibers, which in turn consist of numerous individual thread fibers. In order to subject a transport belt to an intensive cleaning, the rotational speed of the nozzle is reduced to about 1000 rpm to about 2500 rpm. By doing this, the period of spray application to the same area of the transport belt is extended such that obstinate contaminations on the transport belt can be removed. Due to their construction, single-filament sieves, the textile fabric of which consists of interwoven individual textile fibers, can be subjected to an intensive cleaning. By varying the rotational speed of the nozzle, the transport belt can be cleaned gently as well as intensely with a medium under at least substantially constant pressure.

According to another feature of the present invention, a cleaning device is provided that includes a nozzle that rotates about a rotational axis and wherein the central axis of the nozzle opposes the rotational axis and is tilted at an angle $\alpha$, lying in a range from about $2° \leqq |\alpha| \leqq 60°$, preferably from about $5° \leqq |\alpha| \leqq 25°$. The effective range of the nozzle can be varied and therefore the intensity of the cleaning controlled, and preferably adjusted. It has been shown that, depending on the inclination of the nozzle, a larger surface area of the transport belt can be cleaned with a peeling effect (gentle cleaning) or a relatively small surface area can be cleaned with a large cleaning impulse (intensive cleaning), whereby in both cases good cleaning results are attainable.

In accordance with another embodiment of the cleaning device, a nozzle is tilted at an angle $\beta$ with respect to the surface normal of the transport belt, lying in a range of about $-60° \leqq |\beta| \leqq 60°$. As a result, the effective range of the nozzle and the intensity of the cleaning can be influenced in an advantageous manner. Therefore, the smaller the angle $\beta$ becomes, the more obtuse the angle of the spray that impacts the transport belt. In the opposite manner, an increasing angle $\beta$ leads to a decreasing angle between the spray and the transport belt, so that the intensity of the cleaning decreases, whereby a desired cleaning of the transport belt is possible due to the peeling effect of the spray impacting the transport belt, for example, at an acute angle.

In accordance with a further embodiment of the cleaning device, the diameter of the nozzle ranges from about 0.05 mm to about 0.8 mm, and preferably from about 0.1 mm to about 0.4 mm. Through a small nozzle diameter, the use of liquid or gaseous media can be relatively contained, and operational costs of cleaning device can be reduced as a result.

In accordance with a still further embodiment of the cleaning device, the nozzle spaced from the rotational axis by a distance of about 5 mm to about 50 mm, preferably from about 10 mm to about 30 mm. Through the eccentric disposition of the nozzle with respect to the rotational axis, the area affected or cleaning area of the nozzle can be increased such that the effectiveness of the cleaning device can be further improved.

According to another embodiment of the present invention, the nozzle is provided with a medium under a pressure of about 100 bar to about 1000 bar, preferably about 100 bar to about 400 bar. It has been shown that an especially good cleaning result can be attained with a medium under high pressure, like water, for example.

Further embodiments and advantages can be seen from the detailed description of the present invention and the accompanying figures.

BRIEF DESCRIPTION OF THE DRAWINGS

The present invention is further described in the detailed description which follows, in reference to the noted drawing by way of non-limiting examples of preferred embodiments of the present invention, wherein same reference numerals represent similar parts throughout the several views of the drawings, and wherein.

DETAILED DESCRIPTION OF THE INVENTION

The particulars shown herein are by way of example and for purposes of illustrative discussion of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

The device described below is generally usable for cleaning a transport belt of a machine for manufacturing a pulp web. As an example, the cleaning device is usable for cleaning a transport belt of a paper manufacturing machine. In conjunction with the present invention, "transport belt" should be understood as all the belts of the paper manufacturing machine that come into contact with the paper web, for example a sieve belt or a felt of a sieve, a press or a drying section.

Figure 1:
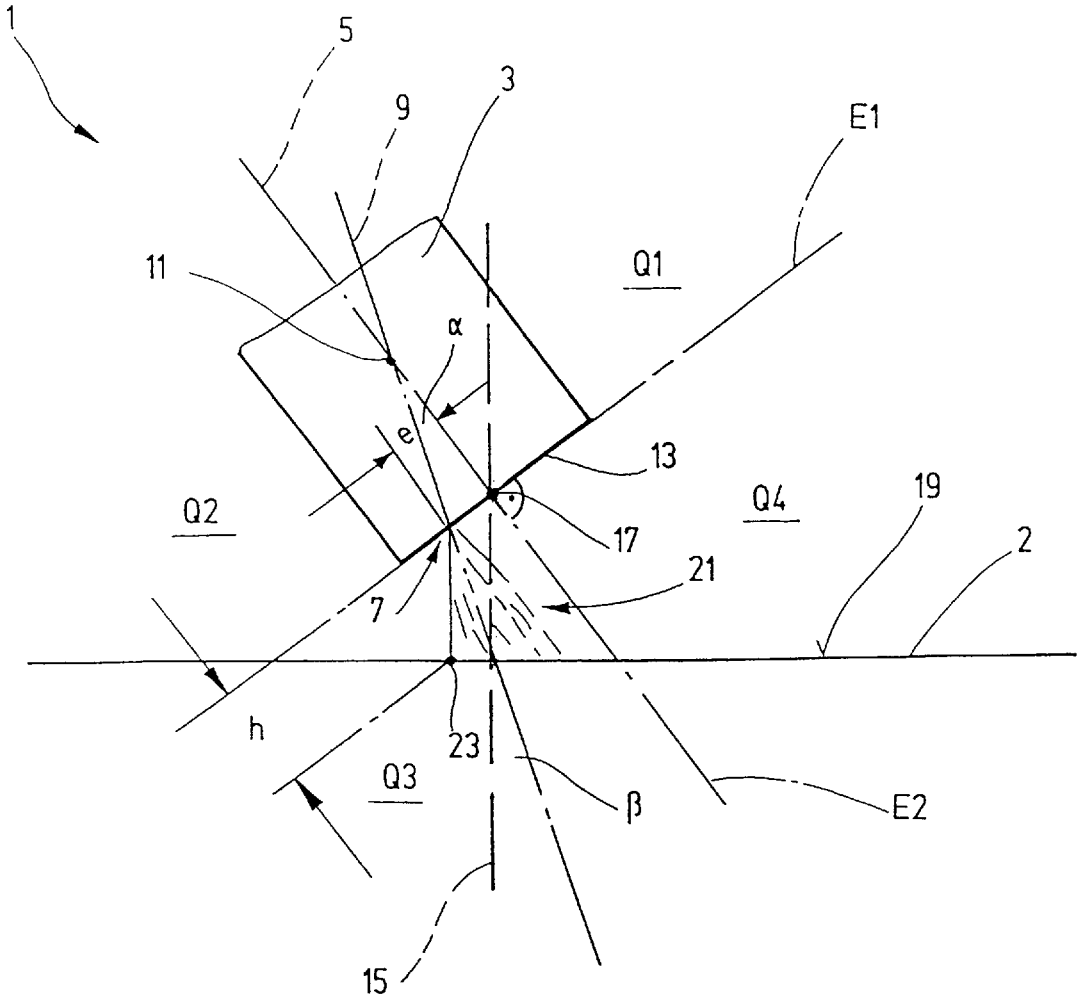
FIG. 1 depicts a schematic segment of an embodiment of the cleaning device in accordance with the invention.

FIG. 1 shows schematically a segment of a first embodiment of a cleaning device 1 for cleaning a transport belt 2, the cleaning device includes a nozzle head 3, that is designed to rotate about its longitudinal axis, hereinafter characterized as a rotational axis 5. The nozzle head 3 includes a cleaning nozzle, not illustrated in more detail, known simply as nozzle 7, which is arranged at a distance e from the rotational axis 5. In another advantageous embodiment, it is contemplated that the nozzle head 3 includes more than one cleaning nozzle, that is, at least a total of two cleaning nozzles. Furthermore, the nozzle head 3 can also include one or more tangentially aligned propelling nozzles for the creation of a rotational movement. The speed of rotation can lie in a range of about 2500 rpm to about 4000 rpm or from about 1000 rpm to about 2500 rpm. Nozzle head 3 is supplied with a high pressure medium from a high pressure pump, not illustrated, which medium is supplied under a pressure of about 100 bar to about 1000 bar, and preferably from about 100 bar to about 400 bar. In the following example, it is assumed that the medium is a fluid. To clean a transport belt 2, one can also use a gaseous medium, such as steam.

The nozzle 7 is inclined at an angle a opposing the rotational axis 5 of the nozzle head 3, where $\alpha$ is the angle between the central axis 9 of the nozzle 7 and the rotational axis 5. In the embodiment depicted in FIG. 1, the point of intersection 11 of the central axis 9 and the rotational axis 5 lies above an inclined first plane E1 (illustrated by the broken line). Therein, the transverse plane 13 of the nozzle head 3 lies facing the transport belt 2. The angle $\alpha$ lies in a range from about 2° to about 60°, preferably between about 5° and about 25°. In another embodiment (not illustrated), the nozzle 7 can be inclined opposing the rotational axis 5 of the nozzle head 3 such that the intersecting point between the central axis 9 of the nozzle 7 and the rotational axis 5 of the nozzle head 3 lies below the first plane E1. The angle $\alpha$ measured between the rotational axis 5 and the central axis 9 in this embodiment has a negative sign. The position of the intersecting point 11 with respect to the first plane E1 therefore determines the sign of the angle $\alpha$.

The rotational axis 5 of the nozzle head 3 lies in a second plane E2 (illustrated by the broken line) that extends upwardly from the plane of the paper on which FIG. 1 is drawn and intersects or crosses the first plane E1 at a point 17 (line of intersection). By virtue of that fact, four quadrants Q1 to Q4 are delimited by the planes E1 and E2. The nozzle 7 is inclined at an angle $\beta$ with respect to the surface normal 15 of the transport belt 2, and the angle $\beta$ is measured between the surface normal 15 of the transport belt 2 and the central axis 9 of the nozzle 7. The angle $\beta$ is preferably chosen less than or equal to about 60° and has a positive sign if the intersecting point between the surface normal 15 and the central axis 9 lies in the first quadrant Q1. If the intersecting point of the surface normal 15 and the central axis 9 (as is depicted in FIG. 1) lies in the third quadrant Q3, then the angle $\beta$ has a negative sign. The angle $\beta$ in the embodiment depicted in FIG. 1 is approximately −20°.

The nozzle 7 is spaced a distance h of about 10 mm to about 100 mm to the surface 19 of the transport belt 2, preferably from about 20 mm to about 50 mm. The distance h is measured between the transverse plane 13 of the nozzle head 3 and a point 23 on which the portion of the spray 21 (depicted by dashed lines) impacts the surface 19 of the transport belt 2 that has covered the smallest distance. The distance h between the nozzle 7 and the transport belt surface 19 is adjustable, preferably variably adjustable. By virtue of this fact, the size of the effective region of the nozzle 7 can be varied, that is, enlarged or reduced.

In a preferred embodiment, the rotating nozzle head 3 includes numerous nozzles 7, from which at least one nozzle 7 is inclined away from the rotational axis 5 and/or the surface normal 15 of the transport belt 2, and away from at least one other nozzle 7, the spray of which runs parallel to the surface normal 15 of the transport belt 2.

Figure 2:
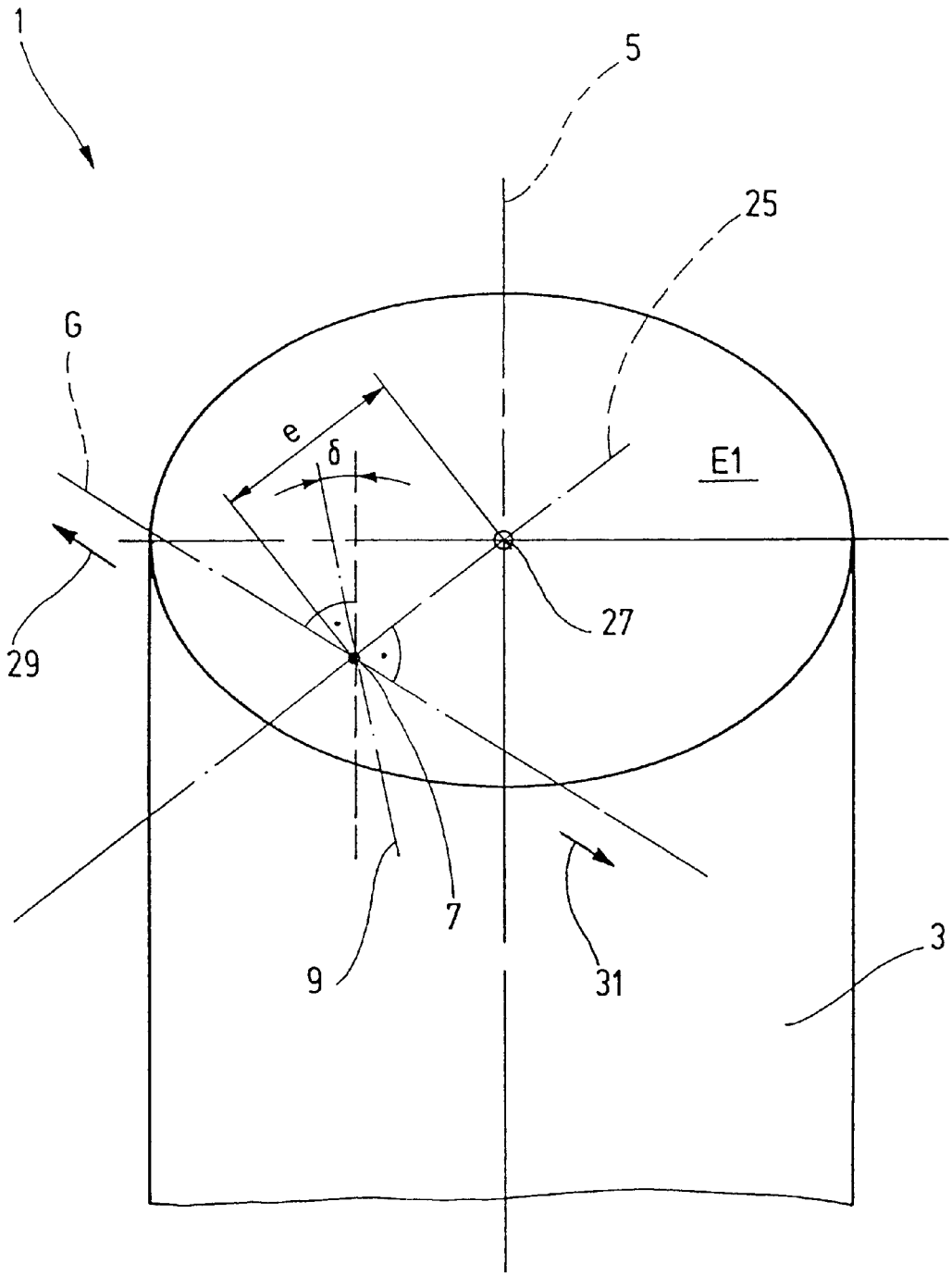
FIG. 2 depicts a perspective view of an embodiment of a nozzle head in accordance with the invention.

FIG. 2 shows a perspective depiction of an embodiment of the nozzle head 3, where only the end region facing the transport belt 2 is depicted. Corresponding parts are provided with corresponding reference numbers, so that their description can be understood by reference to FIG. 1. In FIG. 2, a straight line G is depicted by a broken-line that lies in the first plane E1 and intersects the central axis 9 of the nozzle 7. The straight line G forms a right angle with an assumed axis 25 lying in the first plane E1, which runs through the center 27 of the nozzle head 3 and through the central axis 9 of the nozzle 7. As can be seen in FIG. 2, the nozzle 7 is inclined at an angle $\delta$ opposing the rotational axis 5 in the direction of the straight line G, which lies in a range of about $2° \leqq |\delta| \leqq 60°$, and preferably about $5° \leqq |\delta| \leqq 25°$. The angle δ is measured between the central axis 9 of the nozzle 7 and the rotational axis 5 of the nozzle head 3. With an inclination in the direction of an arrow 29, the angle δ has a positive sign, and with an inclination in the direction of an arrow 31, the angle δ has a negative sign. Through the inclination of the nozzle 7 in the direction of the straight line G, the effective cleaning area, which depends on the size of the angle α, independent of its sign, can be increased or decreased.

In conclusion, it must be remembered that, by configuring the above described nozzle 7 to oppose the rotational axis 5, the surface normal 15 and/or the straight line G, the size of the cleaning area and the intensity of the cleaning can be adjusted such that a gentle and intensive cleaning of the transport belt 2 is possible with a preferably constant, good cleaning result. The intensity of the cleaning can be further adjusted through the level of the rotational speed of the nozzle 7 or the nozzle head 3. With a high rotation speed, the duration of the spray 21 on one point of the transport belt surface is shortened as opposed to that of a lower rotational speed. By virtue of that fact, a gentle as well as an intensive cleaning of the transport belt is possible with a medium that is provided at a substantially constant pressure, regardless of the inclination of the nozzle.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed:

1. A device for cleaning a transport belt of a machine for manufacturing a material web, in a particular paper or cardboard web, comprising:

at least one nozzle for imparting a medium under pressure upon the transport belt, said at least one nozzle having a diameter that ranges from about 0.05 mm to about 0.8 mm, said at least one nozzle being rotatable about a rotational axis, wherein the speed of rotation of the nozzle is variable to vary the intensity of the cleaning, said at least one nozzle is provided with a medium that is under a pressure of about 100 bar to about 1000 bar, and said at least one nozzle is spaced a distance h from the surface of the transport belt, wherein h is within the range of about 10 mm to about 100 mm.

2. A device for cleaning a transport belt in accordance with claim 1, wherein said at least one nozzle is tilted at an angle α with respect to the rotational axis and wherein the angle α lies in the range of about $2° \leqq |\alpha| \leqq 60°$.

3. A device for cleaning a transport belt in accordance with claim 2, wherein said angle α lies in the range of about $5° \leqq |\alpha| \leqq 25°$.

4. A device for cleaning a transport belt in accordance with claim 1, wherein said at least one nozzle is inclined at an angle β with respect to the surface normal of the transport belt and wherein the angle β lies in a range of about $-60° \leqq \beta \leqq 60°$.

5. A device for cleaning a transport belt in accordance with claim 1, wherein said at least one nozzle is inclined at an angle δ with respect to the rotational axis in the direction of a straight line lying on a first plane that intersects the central axis of said at least one nozzle and wherein the angle δ lies in the range of about $2° \leqq |\delta| \leqq 60°$.

6. A device for cleaning a transport belt in accordance with claim 5, wherein said at angle δ lies in the range of about $5° \leqq |\delta| \leqq 25°$.

7. A device for cleaning a transport belt in accordance with claim 1, wherein the diameter of said at least one nozzle ranges from about 0.1 mm to about 0.4 mm.

8. A device for cleaning a transport belt in accordance with claim 1, wherein said at least one nozzle is spaced a distance e from the rotational axis, wherein e is within the range of about 5 mm to about 50 mm.

9. A device for cleaning a transport belt in accordance with claim 8, wherein e is within the range of from about 10 mm to about 30 mm.

10. A device for cleaning a transport belt in accordance with claim 1, wherein said at least one nozzle is provided with a medium that is under a pressure from about 100 bar to about 400 bar.

11. A device for cleaning in accordance with claim 1, wherein h is within the range of from about 20 mm to about 50 mm.

12. A device for cleaning in accordance with claim 1, wherein said spacing h is adjustable, preferably variably adjustable.

13. A device for cleaning in accordance with claim 1, wherein a nozzle head is provided with a plurality of nozzles, and wherein at least one of said nozzles is inclined away from one of the rotational axis and the surface normal of the transport belt, and wherein at least a further nozzle provides a spray which runs parallel to the surface normal of the transport belt.

14. A device for cleaning a transport belt in accordance with claim 1, wherein the speed of rotation of the nozzle lies within the range of from about 2,500 rpm to about 4,000 rpm for gentle cleaning.

15. A device for cleaning a transport belt in accordance with claim 1, wherein the speed of rotation of the nozzle lies within the range of from about 1,000 rpm to about 2,500 rpm for intensive cleaning.

16. A method of cleaning a transport belt of a machine for manufacturing a material web, in particular a paper or cardboard web, comprising:

providing a nozzle head having a rotational axis and providing at least one nozzle on said nozzle head and spaced from said rotational axis;

rotating said nozzle about a rotational axis inclined relative to the surface of the transfer belt to be cleaned;

spraying a medium under a pressure of about 100 bar to about 1000 bar from said nozzle onto the transport belt; and varying the speed of rotation of the nozzle about the rotational axis in a manner to effect one of a gentle cleaning and an intensive cleaning.

17. The method for cleaning a transport belt in accordance with claim 16, further comprising rotating the nozzle at a speed in the range of from about 2,500 rpm to about 2,500 rpm to effect gentle cleaning.

18. The method for cleaning a transport belt in accordance with claim 16, further comprising rotating the nozzle at a speed in the range of from about 1,000 rpm to about 2,500 rpm to effect intensive cleaning.

19. The method for cleaning a transport belt in accordance with claim 16, further comprising providing said at least one nozzle with a diameter that ranges from about 0.05 mm to about 0.8 mm.

* * * * *